US009409399B2

(12) United States Patent
Anderson, Jr. et al.

(10) Patent No.: US 9,409,399 B2
(45) Date of Patent: Aug. 9, 2016

(54) MUZZLE FOR PRINTHEAD ASSEMBLY

(71) Applicant: FUNAI ELECTRIC CO., LTD., Osaka (JP)

(72) Inventors: James Daniel Anderson, Jr., Harrodsburg, KY (US); Sean Weaver, Walton, KY (US)

(73) Assignee: FUNAI ELECTRIC CO., LTD, Osaka (JP)

( * ) Notice: Subject to any disclaimer, the term of this patent is extended or adjusted under 35 U.S.C. 154(b) by 14 days.

(21) Appl. No.: 14/292,319

(22) Filed: May 30, 2014

(65) Prior Publication Data

US 2015/0343784 A1 Dec. 3, 2015

(51) Int. Cl.
*B41J 2/165* (2006.01)
*B41J 2/175* (2006.01)

(52) U.S. Cl.
CPC ..... *B41J 2/16505* (2013.01); *B41J 2/17533* (2013.01)

(58) Field of Classification Search
CPC ..... B41J 2/14024; B41J 2/155; B41J 2/1603; B41J 2/1623; B41J 2/1628; B41J 2/1631; B41J 2/16505; B41J 2/16508; B41J 2/16511; B41J 2/16526; B41J 2/16535; B41J 2/16547; B41J 2/16552; B41J 2/16585
USPC ..... 347/20, 22, 29
See application file for complete search history.

(56) References Cited

U.S. PATENT DOCUMENTS

| | | | | |
|---|---|---|---|---|
| 6,155,678 | A | 12/2000 | Komplin et al. | |
| 6,247,598 | B1 | 6/2001 | Hosaka et al. | |
| 2003/0048338 | A1 | 3/2003 | Qingguo et al. | |
| 2006/0132553 | A1 * | 6/2006 | Droege et al. | 347/84 |
| 2008/0204526 | A1 * | 8/2008 | Pearson et al. | 347/86 |
| 2010/0177140 | A1 * | 7/2010 | Scanlan | 347/29 |

* cited by examiner

*Primary Examiner* — Manish S Shah
*Assistant Examiner* — Roger W Pisha, II
(74) *Attorney, Agent, or Firm* — Amster, Rothstein & Ebenstein LLP

(57) ABSTRACT

A muzzle cap for a printhead assembly including a main body comprising a side wall, a top wall and a bottom wall, a vent seal disposed within an opening in the top wall, a nozzle plate seal disposed within an opening in the bottom wall, and a nozzle plate seal retainer that holds the nozzle plate seal within the opening in the bottom wall.

14 Claims, 18 Drawing Sheets

MUZZLE FOR PRINTHEAD ASSEMBLY

FIELD

The present invention relates generally to inkjet printers, and more particularly, to printhead assemblies for inkjet printers.

BACKGROUND

An ink jet printer typically includes a printhead and a carrier. The ink jet printhead can comprise a printhead body, nozzles, and corresponding ink ejection actuators, such as heaters on a printhead chip. The actuators cause ink to be ejected from the nozzles onto a print medium at selected ink dot locations within an image area. The carrier moves the printhead relative to the medium, while the ink dots are jetted onto selected pixel locations, such as by heating the ink at the nozzles.

In some such systems, the ink reservoir comprises a removable or separable tank, such that the tank can be separated from the printhead, and replaced or refilled, when the ink is low. The printhead components can then be re-used. In such ink tank systems, a separable fluid connection between the tank and the printhead body is needed, in contrast to systems where the printhead body is integral with the ink reservoir. The connection permits ink to flow to the nozzles from the tank, but is separable such that the ink tank can be removed when empty. The printhead assembly can also include a filter within an ink passageway leading from the ink reservoir to the nozzles, for isolating any contaminants or debris from the ejectors and nozzles.

In the industrial market, the proliferation of digital printing is underway. This proliferation provides a unique opportunity for thermal inkjet technology, due to low cost points associated with the bill of materials (BOM) and manufacturing of thermal inkjet printers. The printhead requirements for the industrial market is different and more challenging due to the non-traditional inks being used. The ink chemistries, which are solvent UV curable and latex based, are formulated to wet, penetrate and adhere to non-porous medias (examples of the various substrates are mentioned above). Solvents that are typically used generally have lower surface tension compared to water and will wet lower surface energy surfaces/substrates. Another property that the solvent system provides is the ability of the solvent to cause interfacial diffusion of ink into the substrate allowing for improved adhesion and durability. This is critical due to the non-porous nature of the various substrates used in the industry and the fact that the printed media will be subjected to various environments. Ketones and acetates such as methyl ethyl ketone (MEK) or ethyl acetate are some of the most aggressive solvents used in solvent ink formulations. Currently MEK based inks provide a significant advantage over alcohol-based inks because of its ability to wet and adhere to various plastic (polyolefin base substrates) in a variety of packaging applications/markets.

SUMMARY OF THE INVENTION

Currently, there is not a thermal inkjet printhead that can withstand the aggressive nature of MEK. Accordingly, an object of the present invention is to provide an inkjet printhead that can store and deliver MEK based inks to a substrate.

Due to the nature of the design of the MEK jetting printhead of the present invention, there is a need to completely seal the printhead during shipping so as to prevent leakage of the solvent into the shipping materials. Thus, another object of the present invention is to provide an inkjet printhead that exhibits a good seal during normal shipping environments.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
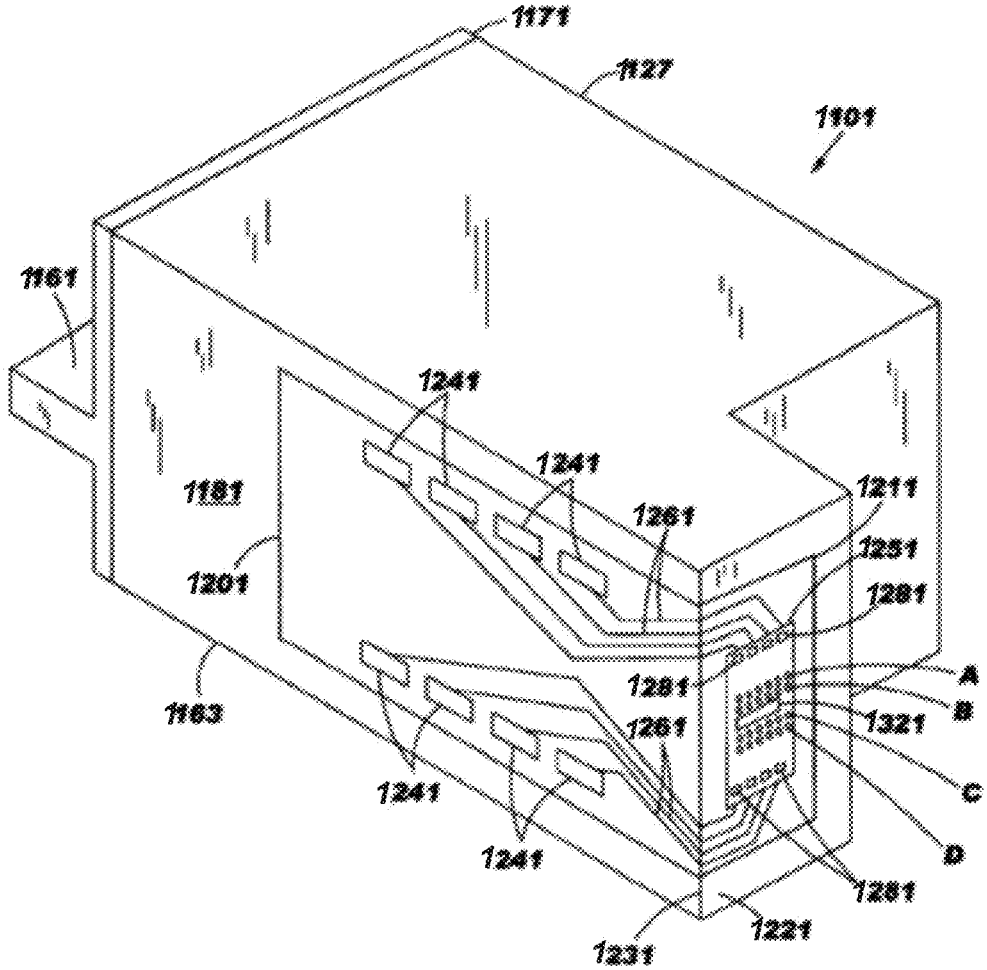
FIG. 1 is a perspective view of a conventional inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

FIG. 1 shows an inkjet printhead generally designated by reference number 1101. The printhead 1101 has a housing 1127 formed of a lid 1161 and a body 1163 assembled together through attachment or connection of a lid bottom surface and a body top surface at interface 1171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate backpressure in the inkjet printhead during use. In one embodiment, the internal compartment includes three chambers for containing three supplies of ink, especially cyan, magenta and yellow ink. In other embodiments, the compartment contains black ink, photo-ink and/or plurals of cyan, magenta or yellow ink. It will be appreciated that fluid connections (not shown) may exist to connect the compartment (s) to a remote source of bulk ink.

A portion 1205 of a tape automated bond (TAB) circuit 1201 adheres to one surface 1181 of the housing while another portion 1211 adheres to another surface 1221. As shown, the two surfaces 1181, 1221 exist perpendicularly to one another about an edge 1231. The TAB circuit 1201 has a plurality of input/output (I/O) connectors 1241 fabricated thereon for electrically connecting a heater chip 1251 to an external device, such as a printer, fax machine, copier, photoprinter, plotter, all-in-one, etc., during use. Pluralities of electrical conductors 1261 exist on the TAB circuit 1201 to electrically connect and short the I/O connectors 1241 to the bond pads 1281 of the heater chip 1251 and various manufacturing techniques are known for facilitating such connections. It will be appreciated that while eight I/O connectors 1241, eight electrical conductors 1261 and eight bond pads 1281 are shown, any number are embraced herein. It is also to be appreciated that such number of connectors, conductors and bond pads may not be equal to one another.

The heater chip 1251 contains at least one ink via 1321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 1251 preferably attaches to the housing with any of a variety of adhesives, epoxies, etc. well known in the art. As shown, the heater chip contains four rows (rows A-row D) of fluid firing elements, especially resistive heating elements, or heaters. For simplicity, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, shown in other figures, with pluralities of nozzle holes adheres over or is fabricated with the heater chip during thin film processing such that the nozzle holes align with the heaters for ejecting ink during use. Alternatively, the heater chip is merely a semiconductor die that contains piezoelectric elements, as the fluid firing elements, for electro-mechanically ejecting ink. As broadly recited herein, however, the term heater chip will encompass both embodiments despite the name "heater" implying an electro-thermal ejection of ink. Even further, the entirety of the heater chip may be configured as a side-shooter structure instead of the roof-shooter structure shown.

Figure 2:
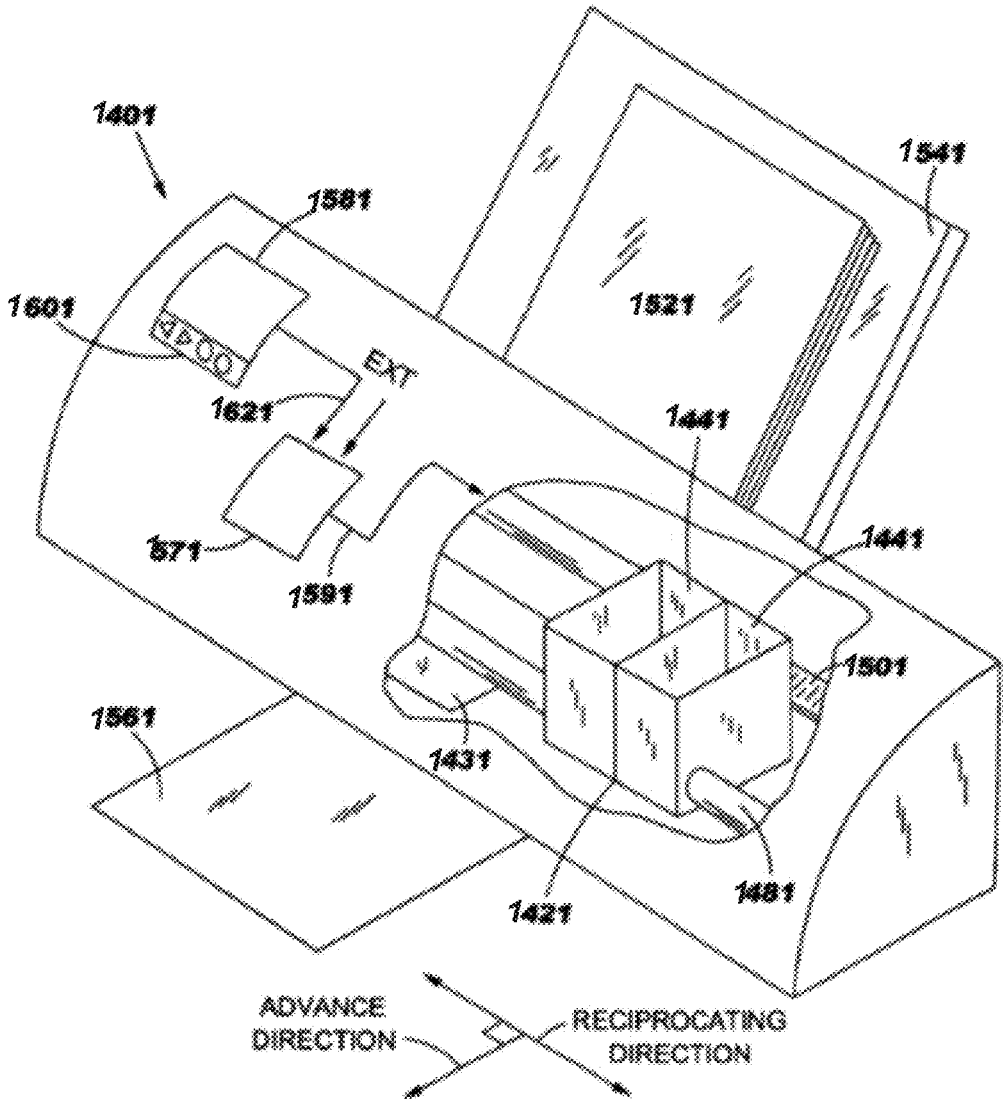
FIG. 2 is a perspective view of a conventional inkjet printer useable with the inkjet printhead assembly according to an exemplary embodiment of the present invention.

FIG. 2 shows an external device in the form of an inkjet printer for containing the printhead 1101, generally designated by reference number 1401. The printer 1401 includes a carriage 1421 having a plurality of slots 1441 for containing one or more printheads. The carriage 1421 is caused to reciprocate (via an output 1591 of a controller 1571) along a shaft 1481 above a print zone 1431 by a motive force supplied to a drive belt 1501 as is well known in the art. The reciprocation of the carriage 1421 is performed relative to a print medium, such as a sheet of paper 1521, that is advanced in the printer 1401 along a paper path from an input tray 1541, through the print zone 1431, to an output tray 1561.

In the print zone, the carriage 1421 reciprocates in the Reciprocating Direction generally perpendicularly to the paper Advance Direction as shown by the arrows Ink drops from the printheads are caused to be ejected from the heater chip 1251 (FIG. 1) at such times pursuant to commands of a printer microprocessor or other controller 1571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other. A control panel 1581 having user selection interface 1601 may also provide input 1621 to the controller 1571 to enable additional printer capabilities and robustness.

To print or emit a single drop of ink, the fluid firing elements (the dots of rows A-D, FIG. 1) are uniquely addressed with a small amount of current to rapidly heat a small volume of ink. This causes the ink to vaporize in a local ink chamber and be ejected through the nozzle plate towards the print medium. The fire pulse required to emit such ink drop may embody a single or a split firing pulse and is received at the heater chip on an input terminal (e.g., bond pad 1281) from connections between the bond pad 1281, the electrical conductors 1261, the I/O connectors 1241 and controller 1571. Internal heater chip wiring conveys the fire pulse from the input terminal to one or many of the fluid firing elements.

In order to operate within industrial printers, a printhead according to exemplary embodiments of the present invention must be able to accommodate ketone, acetate and alcohol based inks. For example, certain materials that are compatible with such inks may be selected for the body and lid of the printhead and internal features and the back pressure system of the printhead may be altered as compared to conventional printheads.

Figure 3:
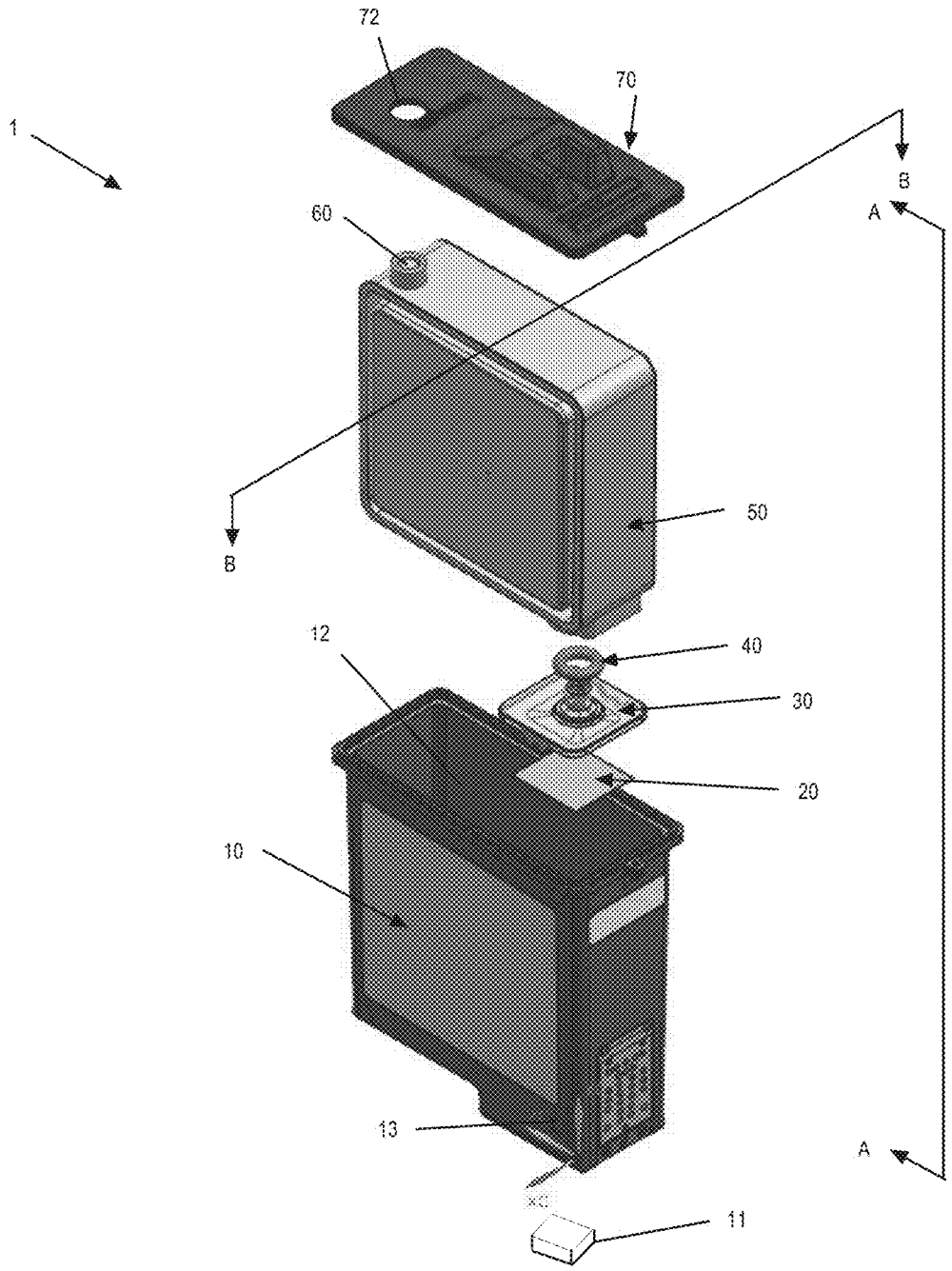
FIG. 3 is an exploded perspective view of a printhead assembly according to an exemplary embodiment of the present invention.
Figure 4:
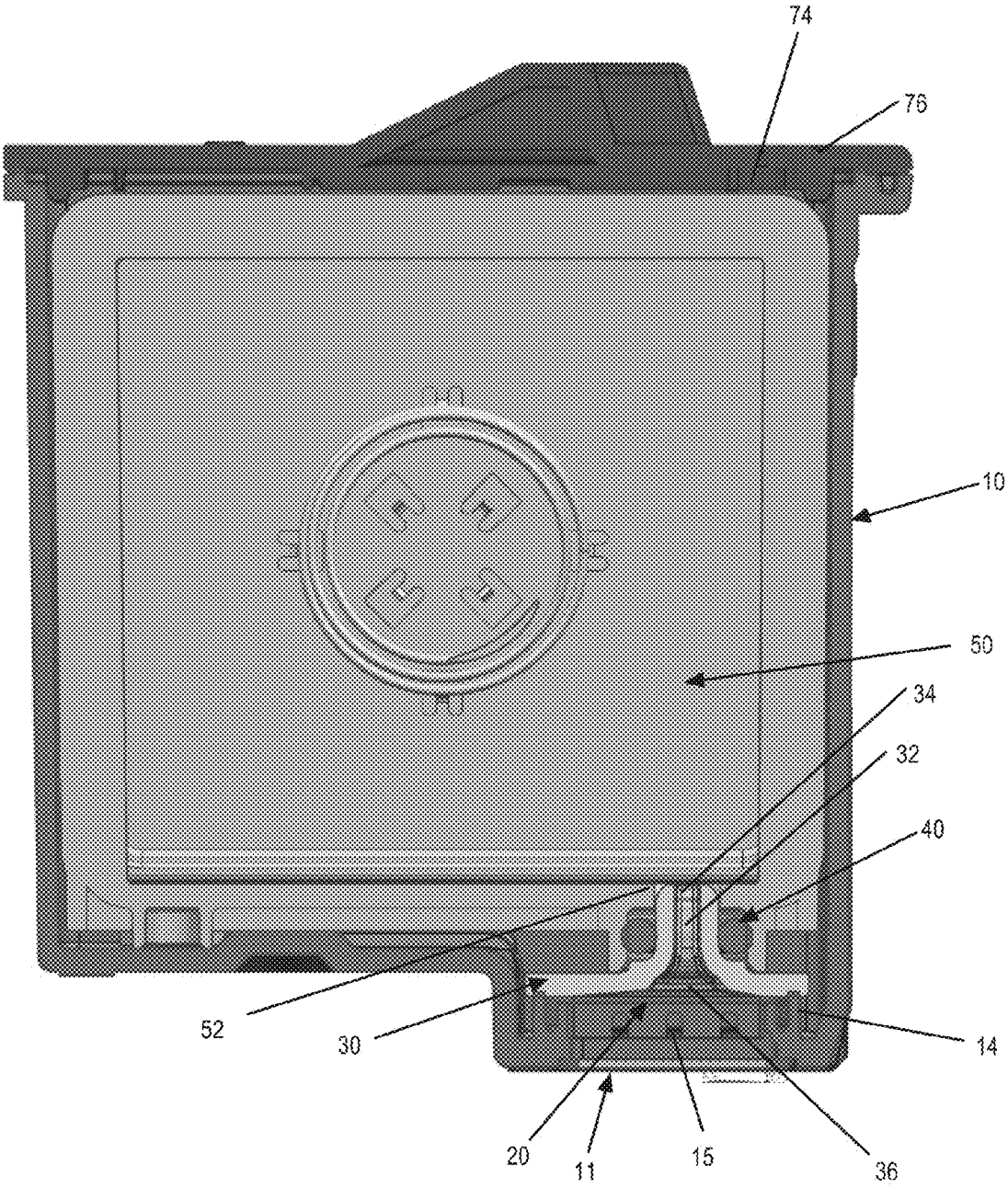
FIG. 4 is a cross-sectional view taken along the line A-A of FIG. 3.
Figure 5:
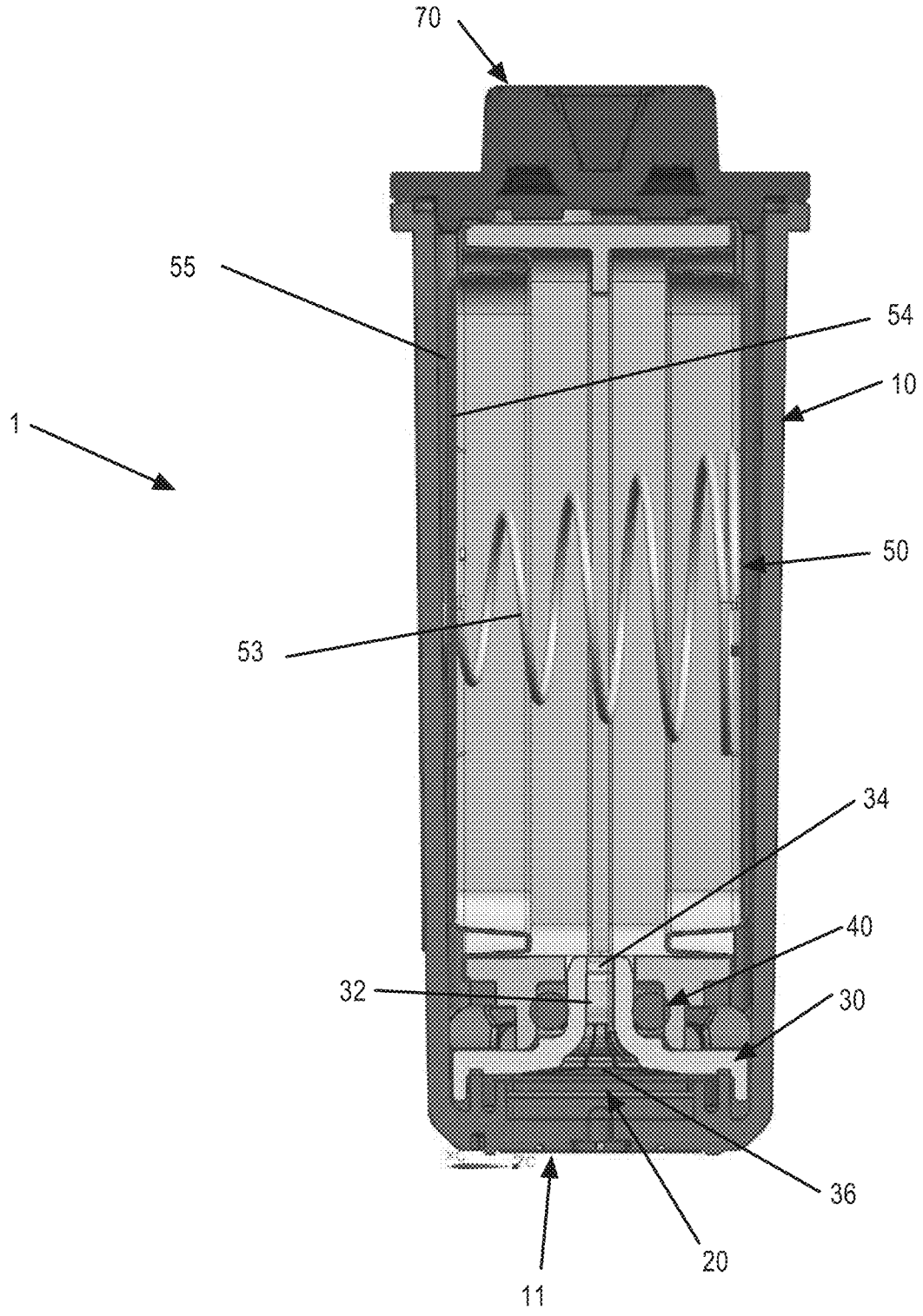
FIG. 5 is a cross-sectional view taken along the line B-B of FIG. 3.

FIG. 3 is an exploded perspective view and FIGS. 4 and 5 are cross-sectional views of a printhead assembly, generally designated as reference number 1, according to an exemplary embodiment of the present invention. The printhead assembly 1 includes an ink cartridge body 10, filter 20, filter cap 30, gasket 40, in reservoir 50, fill ball 60 and lid 70. The ink cartridge body 110 includes a datum surface 13. The ink cartridge body 10 has a chamber 12 that is sized and configured to receive the ink reservoir 50. Although only one ink reservoir 50 is shown in the figures, it should be appreciated that multiple ink reservoirs may be provided to accommodate one or more color inks. The ink reservoir 50 includes an exit port 52 for delivery of the ink, once installed in the chamber 12, and the port 52 can include an interface structure as appropriate, such as a lip or extension. The exit port 52 can be sealed using a removable seal, which can be removed at the time of installation.

Attached to the ink cartridge body 10 is a print head chip 11 including a plurality of nozzles for delivery of the ink to the print medium. In other embodiments, the nozzles are provided on a structure separate from the chip. The ink flows from the exit port 52 of the ink reservoir 50 through channels in the lower portion of the body 10. The ink then flows within the body 10 to a manifold in the print head chip 11, from which it is drawn to the nozzles for ejection onto the print medium, such as by using heater elements or piezoelectric elements formed in the chip 11. The system 1 is moved relative to the print medium, such that the nozzles drop ink at one or more desired locations on the medium.

The lower portion of the ink cartridge body 10 includes a tower 14. The tower 14 may include any appropriate extension, structure, port, or interface for receiving ink for printing. The tower 14 of this example includes a raised tubular extension, or standpipe, having one or more openings 15 through which the ink may flow. Other tower configurations are also possible as will be readily apparent to one of ordinary skill in the art.

As shown in FIGS. 4 and 5, the filter cap 30 engages the tower 14, and in particular may be welded to an upstanding outer perimeter wall of the tower 14. The filter cap 30 includes a conduit or guide component for providing a passage between the ink cartridge body 10 and the ink reservoir 50. In this example, the filter cap 30 includes an inner passage 32 for providing ink therethrough, the passage 32 being defined by a smaller diameter upper passage portion 34 at the ink reservoir end and a larger diameter lower passage portion 36 at the ink cartridge body end. The filter cap 30 may be made of a polyamide, such as, for example, nylon, or other suitable materials that can provide a fluid resistant seal against the tower 14, ink cartridge body 10, and/or ink reservoir 50.

The upper passage portion 34 of the filter cap 30 engages a corresponding exit port 52 of the ink reservoir 50 to allow ink to flow from the ink reservoir 50 to the passage 32 of the filter cap 30. A sealing member is disposed adjacent the filter cap 30 and assists in sealing between the filter cap 30 and the ink reservoir 50. In this example, the sealing member includes the gasket 40 that engages the upper passage portion 34, so as to create a fluidic seal to control fluid and evaporative losses from the system, and prevent air from entering the system to maintain back pressure. The gasket 40 may be made of a suitable elastomer material, or other material with good sealing properties.

The filter 20 filters contaminants in the ink from reaching the printhead chip. The filter 20 can also provide capillary functions to allow ink to pass upon demand to the printhead chip and to prevent air passage into the printhead chip. The filter 20 can be made of a metal weave, a polymer weave, or other mesh, screen, or weave materials. For instance, a stainless steel dutch twill or a stainless steel random weave material may be used to form the filter 20. The filter 20 may be insert injection molded in the tower 14, or otherwise disposed in the ink cartridge body 10. As another example, the filter 20 may be heat staked to the ink cartridge body 10.

The material used to form the ink cartridge body 10 and associated lid 70 may be, for example, nylon (e.g., Nylon 6,6, Nylon 6, Nylon 6,12), polyethersulfone, polypropylene, polyethylene, polyoxymethylene or other materials that are compatible with ketone, acetate and alcohol based inks Since these materials exhibit vapor loss through permeation, a secondary boundary may be provided in the form of the ink reservoir 50. In this regard, the ink reservoir 50 may be made of polypropylene and/or polyethylene based materials so as to create a sufficient permeation barrier. The ink reservoir 50 is also provided to serve as a back pressure device since conventional back pressure devices are made of foam or felt materials, which are easily attacked by ketone, acetate and alcohol based inks. The ink reservoir 50 provides the primary permeation boundary for the ink cartridge body 10 and when the ink reservoir 50 is attached internally to the ink cartridge body 10 and lid 70, a tortuous vent path is created having a high length to area ratio. This tortuous path allows air to move through it, while maintaining a high humidity environment, which reduces evaporative losses and greatly reduces permeation from the system.

Figure 6:
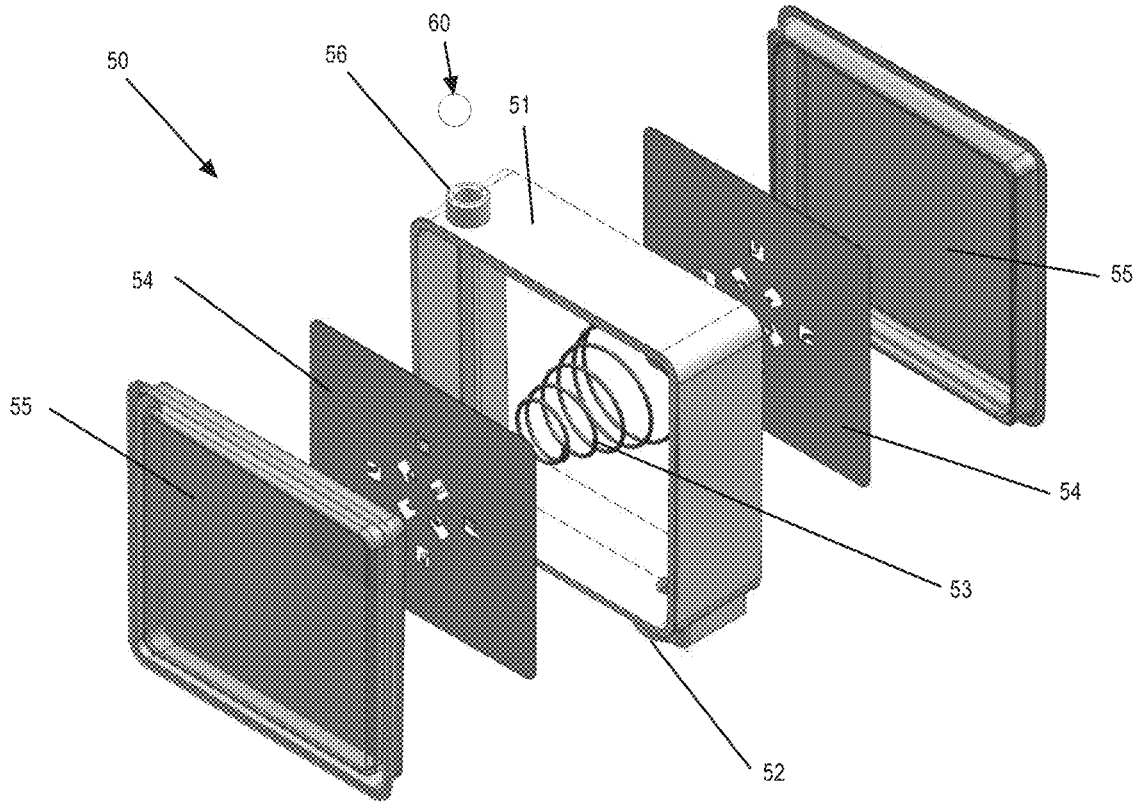
FIG. 6 is an exploded perspective view of an ink reservoir according to an exemplary embodiment of the present invention.

FIG. 6 is an exploded perspective view of the ink reservoir 50. The ink reservoir 50 is made up of a peripheral frame 51, spring 53, side plates 54, and side walls 55. The frame 51 is generally rectangular shaped and is open on both sides. The frame 51 may be made of a polypropylene and/or polyethylene based material. An ink fill hole 56 is disposed at the top of the frame 51. In this regard, the lid includes an opening 72 that corresponds with the ink fill hole 56 of the frame 51, as well as an air vent opening 74 and indent 76 for locking an associated muzzle cap in place (as described in more detail below). The fill ball 60 may be disposed within the ink fill hole 56 to allow for passage of ink into the ink reservoir 50 while preventing leakage of ink out of the ink reservoir 50. The spring 53 may be made from 316 stainless steel or other compatible material, and is used to deliver force to the side plates 54, to generate a back pressure. The side plates 54 may be made of 316 stainless steel or other comparable material, and act as the rigid surface area that generates the back pressure in the system. The side plates 54 may be attached to the spring 53 at either end. In an exemplary embodiment, the side plates 54 may be attached to the side walls 55, though they need not be. The side walls 55 are made of multi-layer polymeric films that are thermally formed and then welded to the sides of the frame 51 to create the chamber needed to store the ink. The polymeric film used to form the side walls 55 may be, for example, thermally formed polypropylene and/or polyethylene film.

During printing, ink is ejected out of the nozzles, causing an increase in negative pressure under the filter 20. This negative pressure pulls ink from above the filter 20 and into the tower 14. Since the ink reservoir 50 is in direct fluid connection with the tower 14, the negative back pressure inside the ink reservoir 50 increases as well. The negative back pressure pulls against the side walls 55 and side plates 54, which causes the spring 53 to collapse further. The spring 53 is what maintains and dictates the static back pressure in the system.

During shipping any inkjet printhead can see temperature and atmospheric changes that can change the internal back pressure in the printhead, which in turn may lead to leaks. With water based inks this can lead to unhappy customers that have ink on their hands when they open the shipping bag, but when solvent based inks are introduced, an added danger exists in that combustible vapors may be released when a bag is opened. In this regard, a muzzle cap according to exemplary embodiments of the present invention keeps the printhead completely sealed during shipping and maintains the pressure inside the printhead cavity equalized with the surrounding atmosphere upon removal of the muzzle cap to minimize the risk of drooling or air ingestion into the printhead. Drooling would produce an unhappy customer from the standpoint of ink dripping everywhere, and in the case of air ingestion, poor print quality. To this end, the muzzle cap according to exemplary embodiments of the present invention seals the nozzle plate, covering each and every nozzle, without causing damage to the nozzle plate, and also seals the atmospheric vent in the printhead to prevent air pressure changes from reaching the back pressure device. The opening of these seals is done in a particular order in order to prevent problems from occurring. In particular, the atmospheric vent must be opened first in order to equalize the internal pressure in the printhead prior to the opening of the nozzles.

Figure 7A:
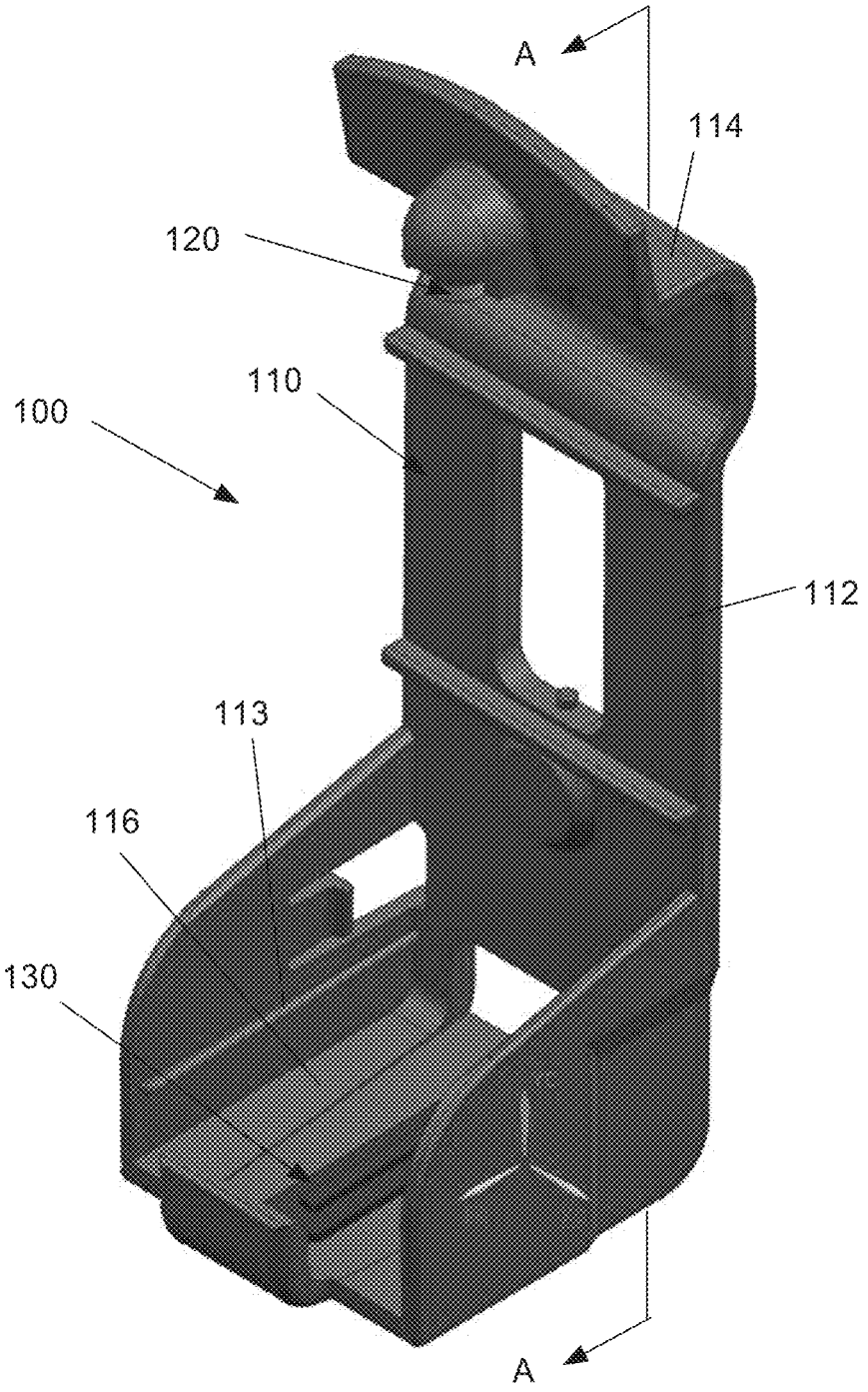
FIG. 7A is a perspective view of a muzzle cap according to an exemplary embodiment of the present invention.
Figure 7B:
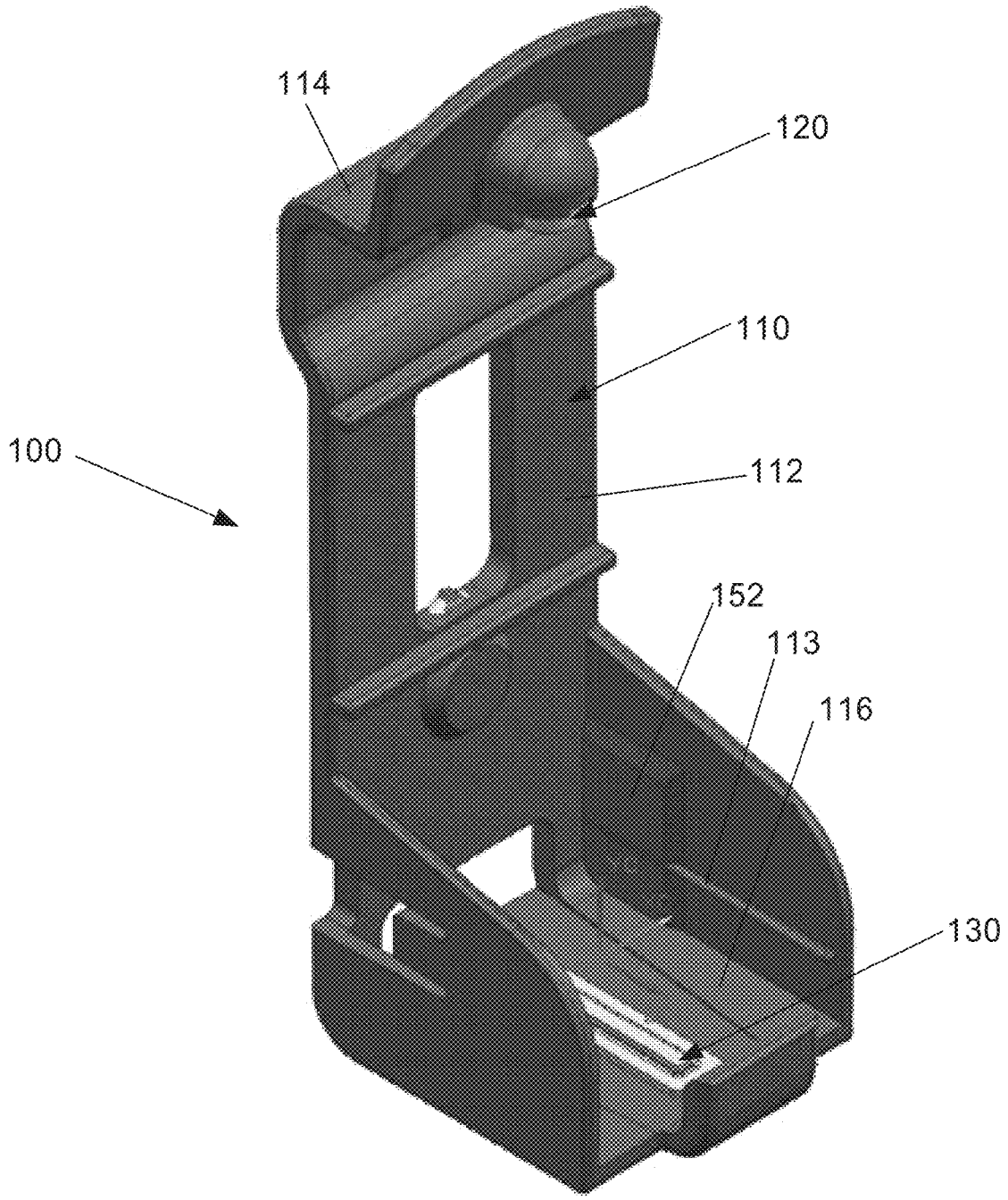
FIG. 7B is another perspective view of the muzzle cap of FIG. 7A.
Figure 8:
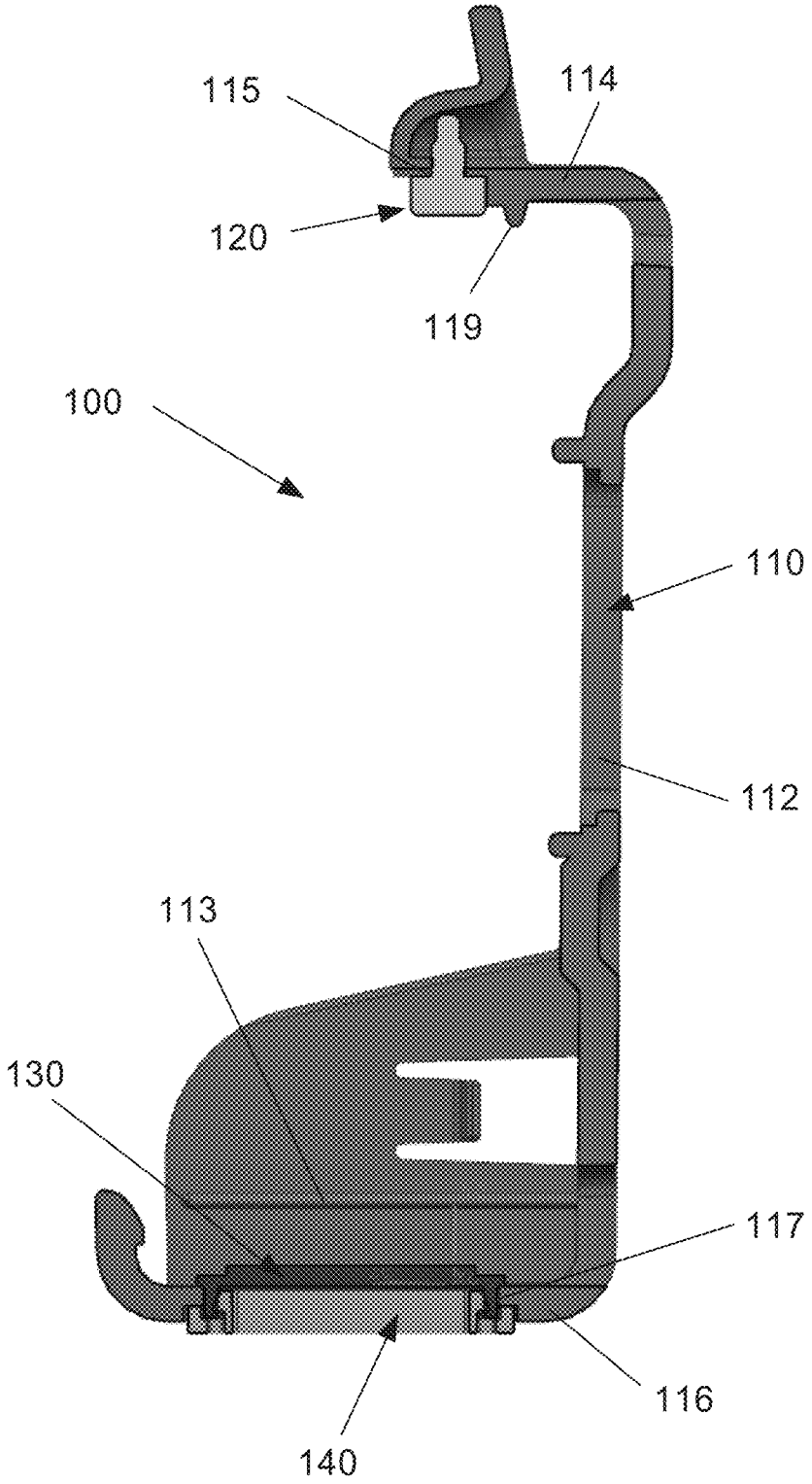
FIG. 8 is a cross-sectional view of the muzzle cap of FIG. 7A taken along the line A-A.
Figure 19:
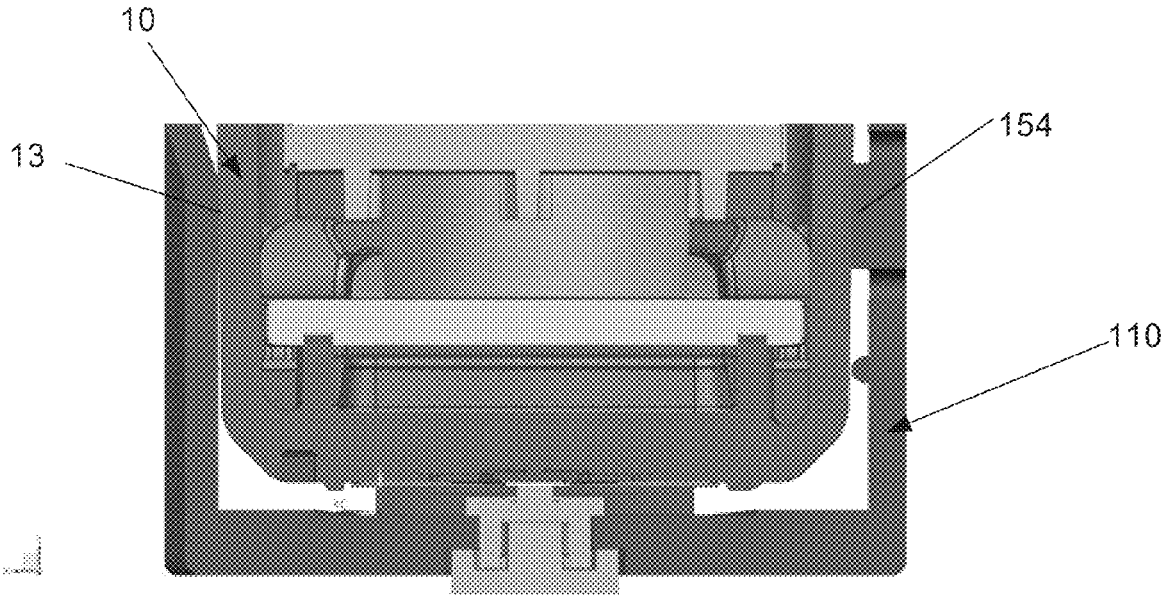

FIGS. 7A and 7B show perspective views and FIG. 8 is a cross-sectional view of a muzzle cap, generally designed by reference number 100, according to an exemplary embodiment of the present invention. The muzzle cap 100 includes a main body 110, vent seal 120, nozzle plate seal 130 and nozzle plate seal retainer 140. The main body 110 may be a unitary member including a side wall 112, a top wall 114 and a bottom wall 116. The main body 110 is made of a plastic that is compatible with the ketone and acetate based inks that is being jetted, so as to not degrade in the presence of the ink. For example, the main body 110 may be made of nylon (e.g., Nylon 6,6, Nylon 6, Nylon 6,12), polyethersulfone, polypropylene, polyethylene, polyoxymethylene or other materials that are compatible with ketone, acetate and alcohol based inks. The main body 110 includes guiding and locking elements, such as protrusions 113 and snap-locking element 119. As described in further detail below, these features locate the vent seal 120 and nozzle plate seal 130 relative to the printhead assembly 1 as accurately as possible so as to cover openings in the printhead assembly 1 and lock the muzzle cap 100 in place relative to the printhead assembly 1. The main body 110 may also contain datum features 152 that directly address datum features 13 on the printhead in order to minimize tolerance stack-ups. In this regard, the main body 110 may include a datum biasing element 154 (FIG. 19) that applies force to push the datum feature 13 of the printhead body 10 into engagement with the datum feature 152 on the main body 110.

Figure 9:
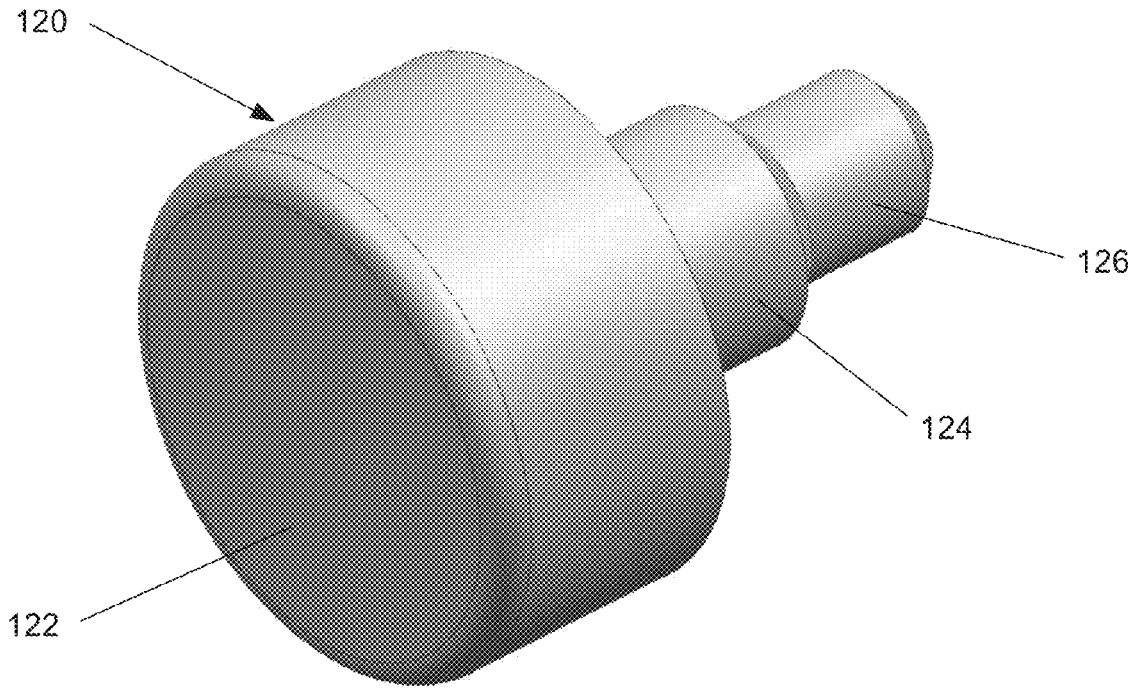
FIG. 9 is a perspective view of a vent seal according to an exemplary embodiment of the present invention.

FIG. 9 is a perspective view of the vent seal 120, which is preferably made of a thermoset elastomer, such as a peroxide cured ethylene propylene diene monomer (EPDM) material, so as to reduce compression set over time and provide maximum resistance to the ketone and acetate solvent inks. The vent seal 120 closes the opening in the printhead assembly 1 that is in direct communication with the atmosphere, where the opening otherwise allows air to enter the internals of the printhead assembly 1 during printing as ink is displaced. The vent seal 120 is a generally cylindrical element portions of which have different diameters from one another. In particular, the vent seal 120 includes a sealing surface portion 122 that interfaces with the air vent opening 74 in the lid 70, where the opening has a raised rim around it. This seals the opening with minimal force. A compression locking portion 124, which has a smaller diameter than the sealing surface portion 122, compresses into an opening 115 in the top wall 114 of the main body 110 of the muzzle cap 100 so as to create an interference fit between the compression locking portion 124 and the opening 115. The assembly lead in portion 126, which has a smaller diameter than the compression locking portion 124, allows the vent seal 120 to be grabbed with a tool to pull the vent seal 120 into place.

Figure 10:
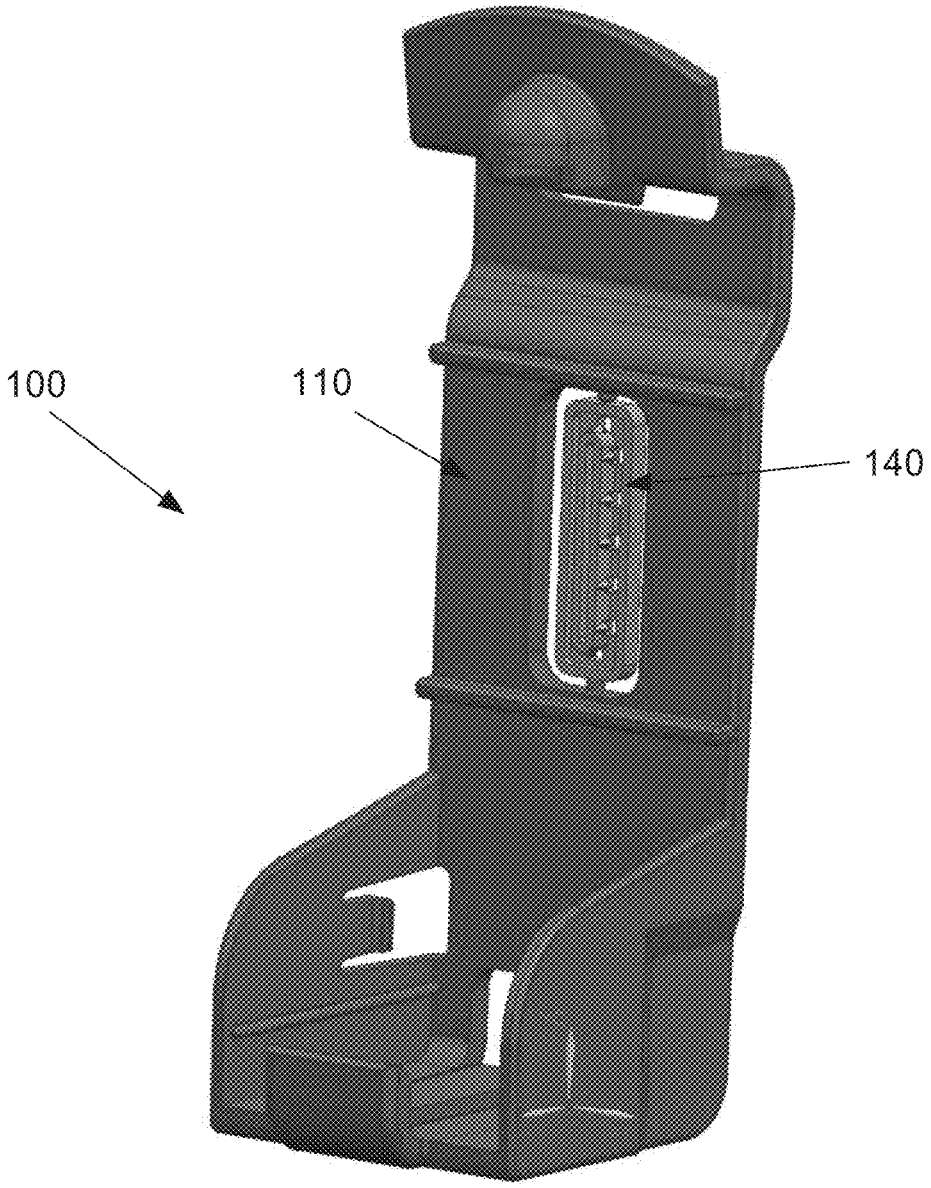
FIG. 10 is a perspective view of a nozzle plate seal retainer molded into a muzzle body according to an exemplary embodiment of the present invention.

As shown in FIG. 10, the nozzle plate seal retainer 140 may be molded into the muzzle body 110 so as to reduce tooling and component costs, and eliminate the need to track an additional component. Prior to use of the muzzle cap 100, the nozzle plate seal retainer 140 is twisted out of the muzzle body 110 and pressed into the nozzle plate seal 130.

Figure 11:
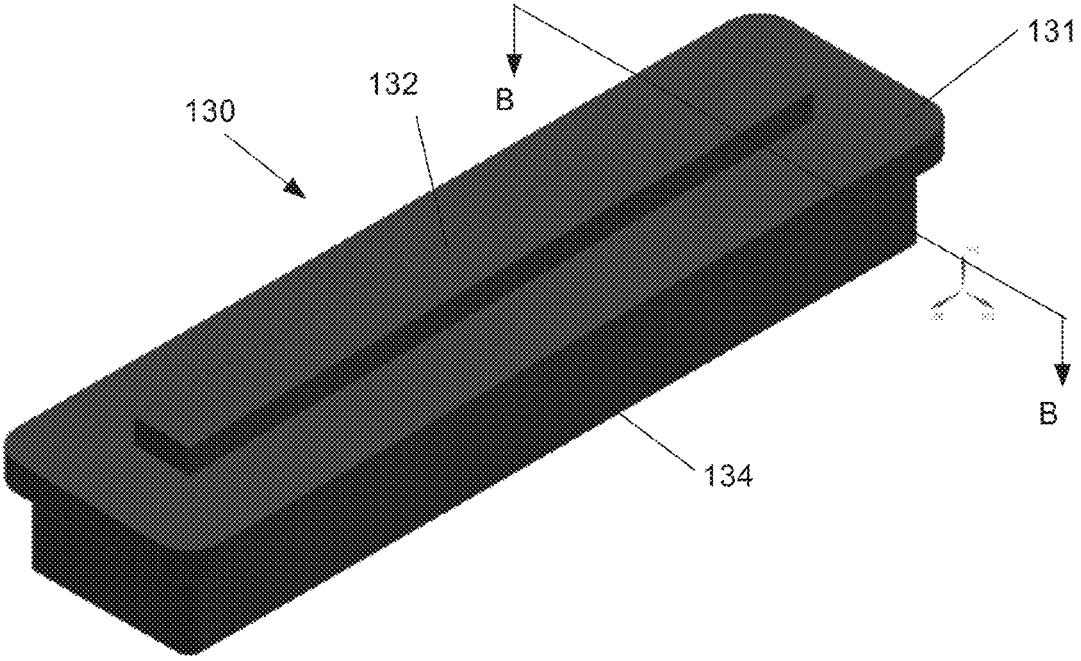
FIG. 11 is a perspective view of a nozzle plate seal according to an exemplary embodiment of the present invention.
Figure 12:
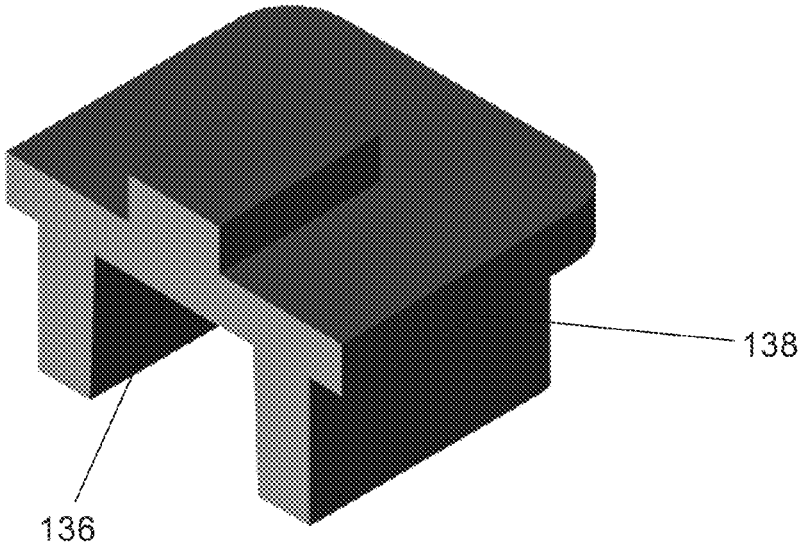
FIG. 12 is a perspective cross-sectional view of the nozzle plate seal of FIG. 11 taken along the line B-B.

FIG. 11 is a perspective view and FIG. 12 is a cross-sectional view of the nozzle plate seal 130. The nozzle plate seal 130 is a generally open-bottomed cuboid shaped element including a top portion 131 and a bottom portion 134. The nozzle plate seal 130 is preferably made of a thermoset elastomer, such as a peroxide cured ethylene propylene diene monomer (EPDM) material, so as to reduce compression set over time and provide maximum resistance to the ketone and acetate solvent inks. The top surface of the top portion 131 of the nozzle plate seal includes an elevated portion that forms a sealing surface 132. The sealing surface 132 has a smooth finish that allows good sealing to the nozzles. The perimeter of the bottom portion 134 locates the nozzle plate seal 130 in a corresponding opening 117 in the muzzle body 110, and, as described in further detail below, when used in conjunction with the nozzle plate seal retainer 140, centers the nozzle plate seal 130 in the muzzle body 110. The bottom surface of the top portion 131 forms a flexing floor 136 that flexes to reduce the force applied to the nozzle plate and to also provide a uniform distribution of force on the nozzle plate to aid in sealing. The top portion 131 of the nozzle plate seal 130 extends over the bottom portion 134 so as to form a retaining lip 138 that acts as a stop for the nozzle plate seal 130 once assembled.

Figure 13:
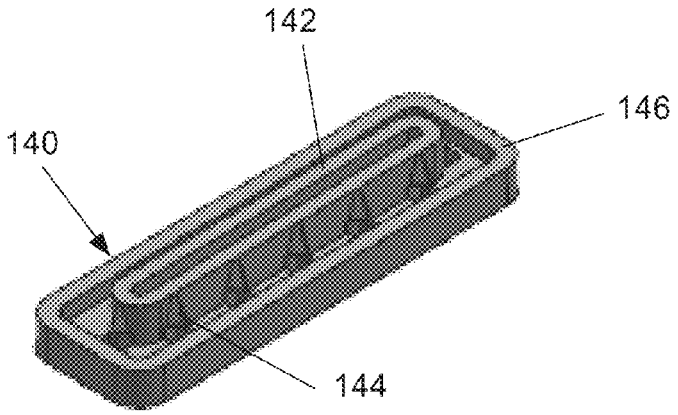
FIG. 13 is a perspective view of a nozzle plate seal retainer according to an exemplary embodiment of the present invention.

FIG. 13 is a perspective view of the nozzle plate seal retainer 140, which is preferably made of a plastic material, such as nylon. The nozzle plate seal retainer 140 includes a top surface having an elevated portion 142. Teeth-like locking projections 144 are arranged around the perimeter of the elevated portion 142. The top surface also includes an elevated perimeter forming a rim 146.

Figure 14:
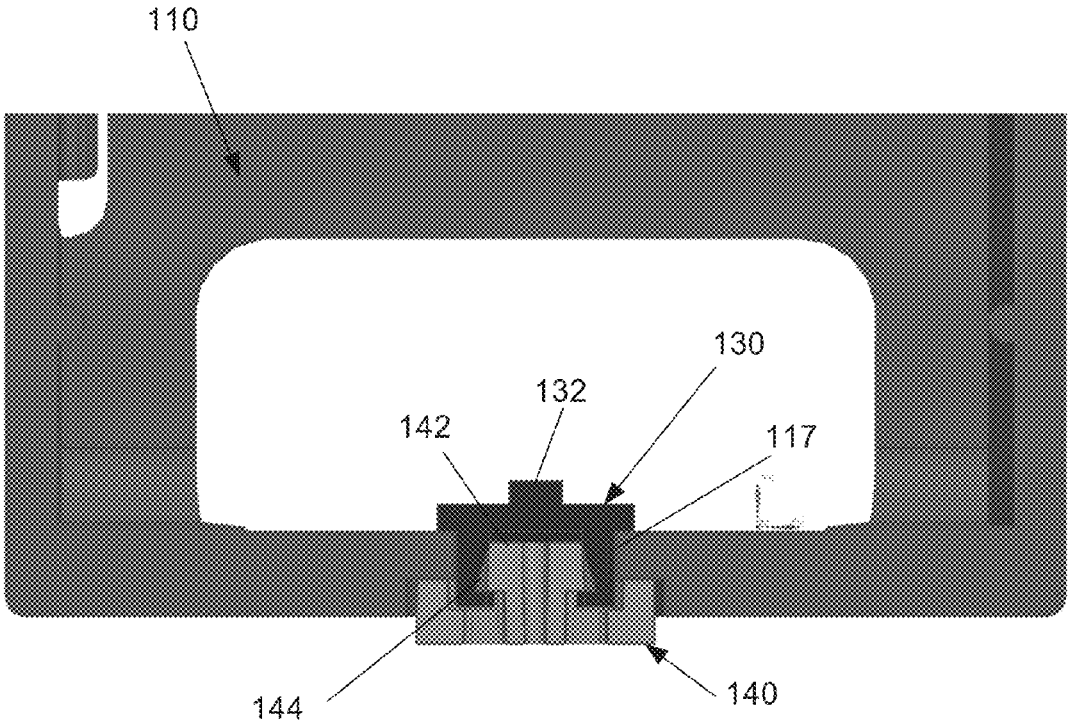
FIG. 14 is a cross-sectional view showing a nozzle plate seal and nozzle plate seal retainer assembled with a muzzle body according to an exemplary embodiment of the present invention.
Figure 15:
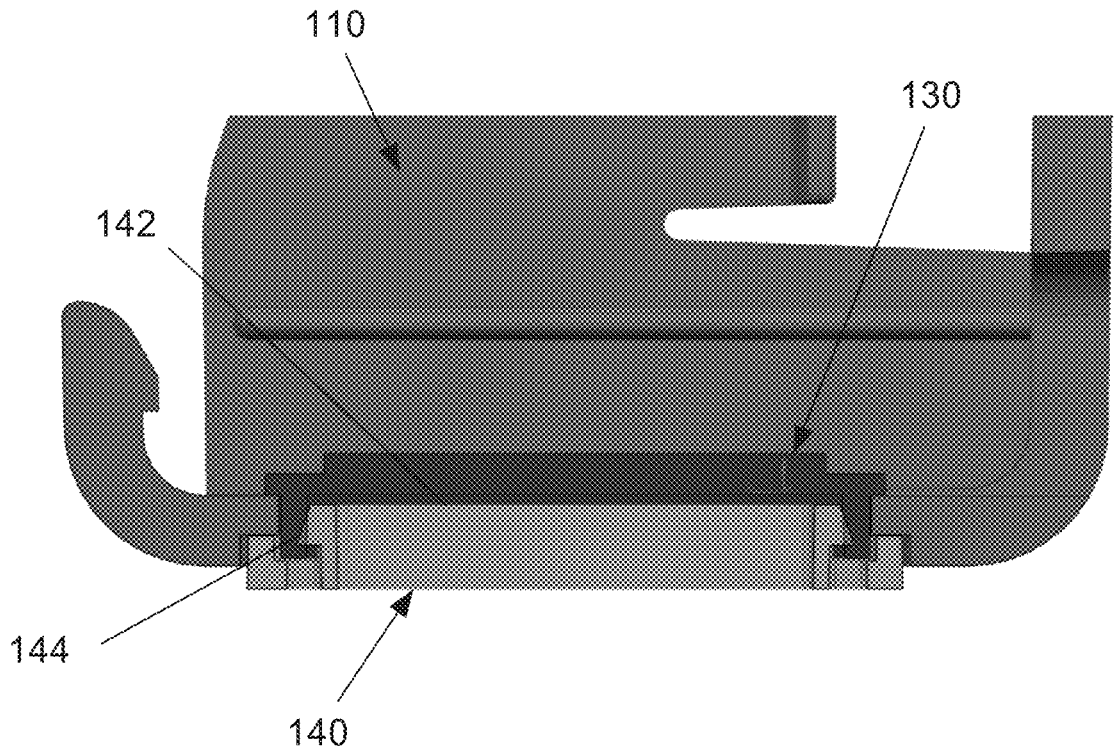
FIG. 15 is another cross-sectional view showing a nozzle plate seal and nozzle plate seal retainer assembled with a muzzle body according to an exemplary embodiment of the present invention.

As shown in FIGS. 14 and 15, in order to assemble the muzzle cap 100, after the nozzle plate seal 130 is disposed within the opening 117, the nozzle plate seal retainer 140 is engaged with the nozzle plate seal 130 by sliding the elevated portion 142 of the nozzle plate seal retainer 140 into the open bottom of the nozzle plate seal 130. The locking projections 144 "bite into" the elastomer material of the nozzle plate seal 130 to retain the nozzle plate seal 130 in place, while naturally centering the nozzle plate seal 130 in the muzzle body opening 117.

Figure 16:
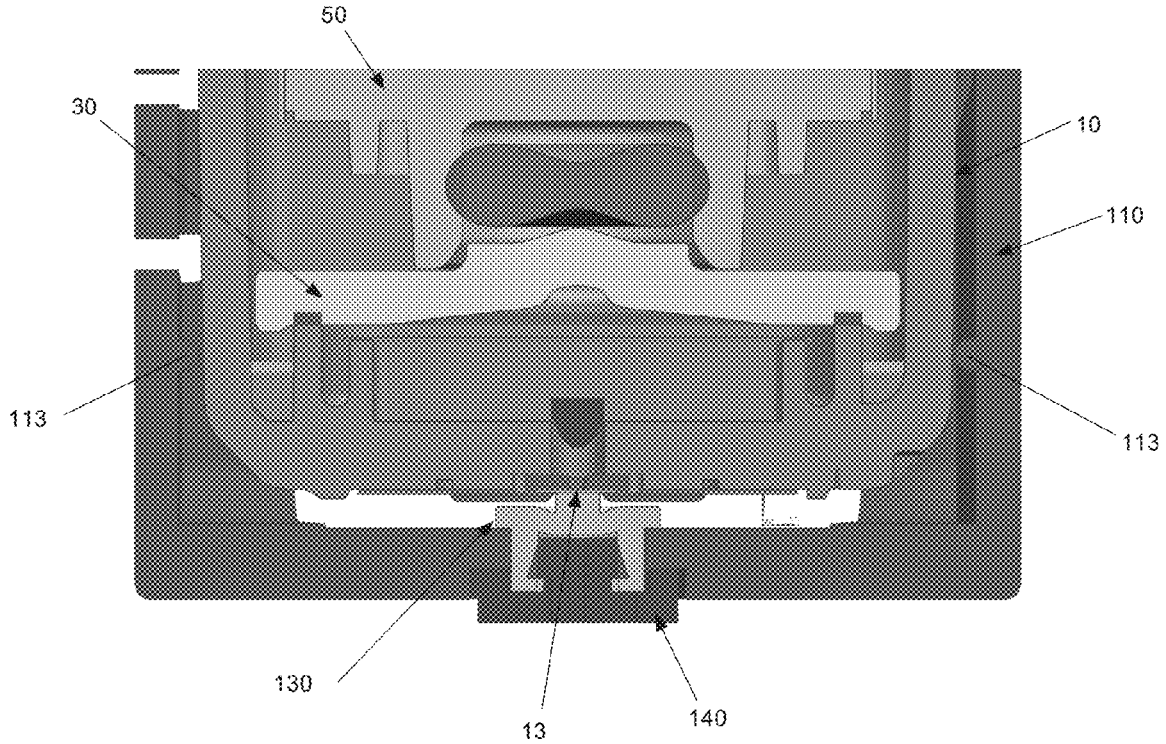
FIG. 16 is a cross-sectional view of a muzzle cap attached to a printhead assembly according to an exemplary embodiment of the present invention.
Figure 17:
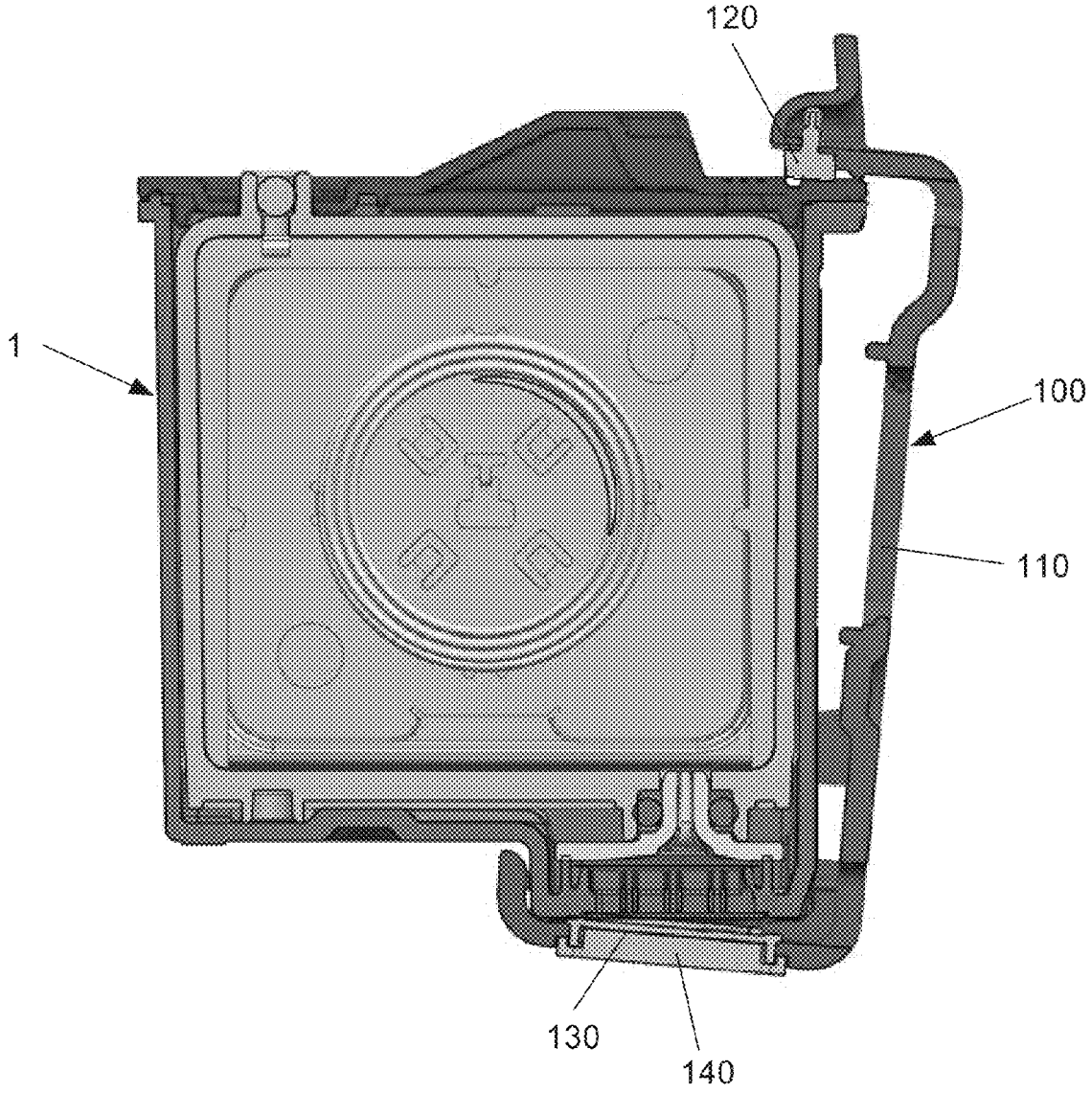
FIGS. 17-19 are cross-sectional views showing assembly of a muzzle cap onto a printhead assembly according to an exemplary embodiment of the present invention.
Figure 18:
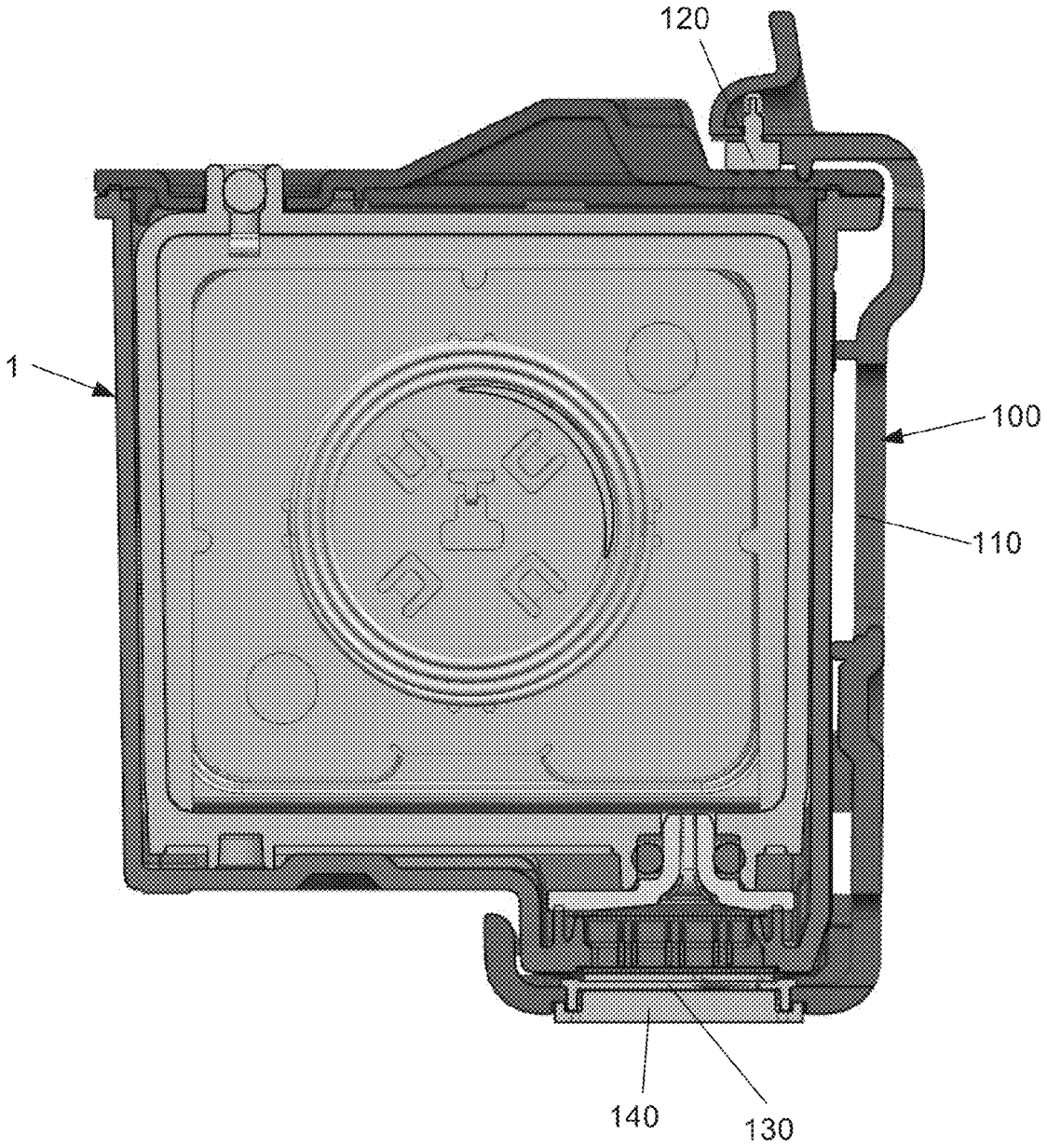

FIGS. 16-18 show assembly of the muzzle cap 100 onto the printhead assembly 1. The muzzle cap 100 is placed on the printhead assembly 1 in a manner such that the nozzle plate seal 110 engages and seals the nozzle plate before the vent seal 120 engages and seals the air vent opening in the lid 70 of the printhead assembly 1. In particular, as shown in FIG. 16, as the muzzle cap 100 is assembled to printhead assembly 1, the datums in the printhead are guided by guides 113 and biased to a datum pad in the muzzle body 110 to provide proper alignment to the nozzle plate seal 130. As shown in FIGS. 17 and 18, the sequence of steps taken to place the muzzle cap 100 on the printhead assembly 1 may include a first step of engaging the bottom portion of the muzzle cap 100 with the bottom portion of the printhead assembly 1, and then sliding the snap locking element 119 onto the lid 70 so that the snap locking element 119 engages with the indent 76, thereby locking the muzzle cap 100 in place relative to the printhead assembly 1. Engagement of the snap locking element 119 with the indent 76 in the lid 70 ensures proper placement of the vent seal 120 over the air vent opening 74 and also causes the nozzle plate seal 130 to deflect into tight engagement with the nozzle plate 13, thereby preventing damage to the nozzle plate 13 and maintaining a uniform force across the nozzle plate 13. When removing the muzzle cap 100, the snap locking element 119 must first be disengaged from the lid 70. This allows internal air pressure in the printhead to equalize to atmosphere prior to removal of the nozzle plate seal 130, thereby minimizing drooling due to pressure differentials.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A muzzle cap for a printhead assembly, comprising:

a main body comprising a side wall, a top wall and a bottom wall;

a vent seal disposed within an opening in the top wall;

a nozzle plate seal disposed within an opening in the bottom wall, wherein the nozzle plate seal comprises a top portion and a bottom portion, the bottom portion forming an opening, the top portion comprising an elevated portion adapted for engagement with a nozzle plate of a printhead; and a nozzle plate seal retainer that holds the nozzle plate seal within the opening in the bottom wall.

2. The muzzle cap of claim 1, wherein at least one of the main body, the vent seal, the nozzle plate seal or the nozzle plate seal retainer is made of nylon.

3. The muzzle cap of claim 1, wherein the main body comprises protrusions that guide a printhead assembly into engagement with the muzzle cap.

4. The muzzle cap of claim 1, wherein the vent seal has a cylindrical shape.

5. The muzzle cap of claim 1, wherein the nozzle plate seal retainer comprises an elevated portion adapted for engagement with the opening of the nozzle plate seal so as to retain the nozzle plate seal in place within the opening in the bottom wall of the main body.

6. The muzzle cap of claim 5, wherein the nozzle plate seal retainer further comprises locking members arranged around the perimeter of the elevated portion of the nozzle plate seal, the locking members adapted for engagement with the bottom portion of the nozzle plate seal.

7. The muzzle cap of claim 1, further comprising a protrusion extending form the top wall of the main body, the protrusion adapted for engagement with an opening in a lid of the printhead assembly so that the protrusion must be removed from the opening in the lid before the muzzle cap can be removed from the printhead assembly.

8. A combination comprising:

a printhead assembly comprising:

an ink cartridge body that defines a chamber, the ink cartridge body being made of a material selected from the group of materials consisting of: nylon, polyethersulfone, polypropylene, polyethylene, polyoxymethylene and other materials that are compatible with ketone, acetate and alcohol based inks;

an ink reservoir disposed within the chamber of the ink cartridge body and adapted to receive and contain ink;

a lid disposed over the chamber of the ink cartridge body, the lid comprising an air vent;

a printhead chip provided on the ink cartridge body and in fluid communication with the ink reservoir so as to receive ink from the ink reservoir for ejection of the ink onto a print medium, the printhead comprising a nozzle plate; and a muzzle cap comprising:

a main body comprising a side wall, a top wall and a bottom wall;

a vent seal disposed within an opening in the top wall and adapted for engagement with the air vent of the printhead assembly;

a nozzle plate seal disposed within an opening in the bottom wall and adapted for engagement with the nozzle plate of the printhead, wherein the nozzle plate seal comprises a top portion and a bottom portion, the bottom portion forming an opening, the top portion comprising an elevated portion adapted for engagement with a nozzle plate of a printhead; and a nozzle plate seal retainer that holds the nozzle plate seal within the opening in the bottom wall.

9. The combination of claim 8, wherein at least one of the main body, the vent seal, the nozzle plate seal or the nozzle plate seal retainer is made of nylon.

10. The combination of claim 8, wherein the main body comprises protrusions that guide the printhead assembly into engagement with the muzzle cap.

11. The combination of claim 8, wherein the vent seal has a cylindrical shape.

12. The combination of claim 8, wherein the nozzle plate seal retainer comprises an elevated portion adapted for engagement with the opening of the nozzle plate seal so as to retain the nozzle plate seal in place within the opening in the bottom wall of the main body.

13. The combination of claim 12, wherein the nozzle plate seal retainer further comprises locking members arranged around the perimeter of the elevated portion of the nozzle plate seal, the locking members adapted for engagement with the bottom portion of the nozzle plate seal.

14. The combination of claim 8, further comprising a protrusion extending form the top wall of the main body, the protrusion adapted for engagement with an opening in the lid of the printhead assembly so that the protrusion must be removed from the opening in the lid before the muzzle cap can be removed from the printhead assembly.

* * * * *